US009284779B2

(12) United States Patent
Gillis

(10) Patent No.: US 9,284,779 B2
(45) Date of Patent: Mar. 15, 2016

(54) DRILLING APPARATUS

(75) Inventor: Sean Gillis, Beaumont (CA)

(73) Assignee: DRILFORMANCE TECHNOLOGIES LLC, Houston, TX (US)

( * ) Notice: Subject to any disclaimer, the term of this patent is extended or adjusted under 35 U.S.C. 154(b) by 728 days.

(21) Appl. No.: 13/404,419

(22) Filed: Feb. 24, 2012

(65) Prior Publication Data

US 2012/0228035 A1 Sep. 13, 2012

Related U.S. Application Data

(60) Provisional application No. 61/450,233, filed on Mar. 8, 2011.

(30) Foreign Application Priority Data

Feb. 22, 2012 (CA) ..... 2769141

(51) Int. Cl.
*E21B 10/00* (2006.01)
*E21B 4/00* (2006.01)

(52) U.S. Cl.
CPC *E21B 4/003* (2013.01); *E21B 10/00* (2013.01)

(58) Field of Classification Search
CPC ..... E21B 4/02; E21B 4/003; E21B 10/00
USPC ..... 175/371, 367, 92, 95, 97, 107, 359
See application file for complete search history.

(56) References Cited

U.S. PATENT DOCUMENTS 3,145,787 A 8/1964 Brown
3,722,608 A 3/1973 Faulk
3,730,284 A 5/1973 Striegler
3,807,513 A 4/1974 Kern et al.
3,866,988 A 2/1975 Striegler
4,232,751 A * 11/1980 Trzeciak ..... 175/101
4,261,425 A 4/1981 Bodine
4,271,915 A 6/1981 Bodine
4,372,403 A 2/1983 Beeman
5,099,931 A * 3/1992 Krueger ..... E21B 7/068 175/107
6,290,002 B1 * 9/2001 Comeau ..... E21B 7/067 175/61
6,607,044 B1 8/2003 Eppink et al.
7,287,605 B2 * 10/2007 Van Steenwyk et al. ..... 175/61
7,677,335 B2 * 3/2010 Cao et al. ..... 175/61
7,757,781 B2 * 7/2010 Hay et al. ..... 175/26
8,062,140 B2 * 11/2011 Wall et al. ..... 464/152
8,721,182 B2 * 5/2014 Cioceanu ..... 384/97
2002/0088648 A1 * 7/2002 Krueger et al. ..... 175/99
2009/0159281 A1 * 6/2009 Herrera ..... E21B 7/203 376/285
2010/0038142 A1 * 2/2010 Snyder et al. ..... 175/107
2011/0147091 A1 * 6/2011 Bullin ..... 175/107
2012/0205158 A1 * 8/2012 Barnes et al. ..... 175/57

FOREIGN PATENT DOCUMENTS

GB 1400123 7/1975

* cited by examiner

*Primary Examiner* — Kenneth L Thompson
*Assistant Examiner* — Michael Wills, III
(74) *Attorney, Agent, or Firm* — Terrence N. Kuharchuk; Rodman & Rodman LLP

(57) ABSTRACT

A drilling apparatus including a housing, a drill bit having a head end, a connection end, and a bearing mandrel between the head end and the connection end, a bearing pack associated with the bearing mandrel and the housing for transmitting forces between the drill bit and the housing, the bearing pack including at least one bearing interposed between the bearing mandrel and the housing, and a drive mechanism connected with the connection end of the drill bit, for driving the drill bit.

18 Claims, 5 Drawing Sheets

DRILLING APPARATUS

TECHNICAL FIELD

A drilling apparatus including a drill bit and a bearing pack.

BACKGROUND OF THE INVENTION

A downhole drilling assembly is typically connected to a lower end of a drill string in order to conduct drilling operations in a borehole. A downhole drilling assembly may be comprised of equipment including, but not limited to, drill collars, stabilizers, reamers, sensors, LWD/MWD communication systems, and/or one or more drilling apparatus.

A drilling apparatus in a downhole drilling assembly may be comprised of apparatus including, but not limited to, a downhole drilling motor, a rotary steerable tool, a steering tool, or a combination of such apparatus. A drill bit is typically included at a lower end of the drilling apparatus. A bearing pack typically transmits forces between the drill bit and a housing of the drilling apparatus.

It is widely accepted that a drilling apparatus that is as short as possible may provide many potential advantages, particularly when the drilling apparatus includes a bend and is used for directional drilling. Drilling holes with a higher rate of curvature, extending bearing life and improving toolface control are among some of the potential benefits of a relatively short drilling apparatus. Drilling in rotary mode with a drilling apparatus including a bend may also be possible with larger bend angles if the drilling apparatus is relatively short.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention is directed at configurations of a drill bit and a bearing pack in a drilling apparatus. The present invention is also directed at a drilling apparatus which is comprised of a drill bit and a bearing pack associated with the drill bit.

In some embodiments, the invention may potentially facilitate a reduction in the length of the drilling apparatus in comparison with prior art drilling apparatus.

The drilling apparatus may be any structure, device or apparatus or combination of structures, devices and apparatus which may be used in drilling boreholes and which includes a drill bit and a bearing pack. By way of non-limiting examples, in some embodiments the drilling apparatus may be comprised of, may consist of, or may consist essentially of components of a downhole drilling motor, a steering tool, or a rotary steerable tool.

In some embodiments, the drilling apparatus may be comprised of a housing so that the bearing pack transmits radial and/or axial forces between the drill bit and the housing.

In some embodiments, the drilling apparatus may be further comprised of a drive mechanism directly or indirectly connected with the drill bit, for driving the drill bit. The drive mechanism may be comprised of any structure, device or apparatus which is capable of directly or indirectly exerting a drive force on the drill bit. In some embodiments, the drive mechanism may drive the drill bit by rotating the drill bit.

In some embodiments, the drilling apparatus may be comprised of components of a downhole drilling motor and the drive mechanism may be comprised of or may be connected with one or more components of the downhole drilling motor.

In some embodiments, the drilling apparatus may be comprised of components of a steering tool or a rotary steerable tool and the drive mechanism may be comprised of or may be connected with one or more components of the steering tool or the rotary steerable tool.

In some embodiments, the drive mechanism may be comprised of or may be connected with one or more components of a drill string which is driven by a surface motor.

The drive mechanism of the drilling apparatus may be comprised of, may consist of, or may consist essentially of any suitable structure, device or apparatus or combination of suitable structures, devices or apparatus.

In some embodiments, the drive mechanism of the drilling apparatus may be comprised of a power section and a transmission. The power section may be comprised of any suitable structure, device or apparatus, including but not limited to a positive displacement (i.e., Moineau type) motor, a fluid driven turbine, or an electrical motor. The transmission may be comprised of any suitable structure, device or apparatus, including but not limited to a constant velocity assembly or a flex shaft.

In some embodiments in which the drilling apparatus may, be comprised of components of a downhole drilling motor, the drill bit and the bearing pack may replace the bearing section which is typically included below the transmission in a prior art drilling motor. In some such embodiments, the drill bit may be adapted to be connected either directly or indirectly with the transmission of the drilling motor.

In some embodiments, the drill bit may have a head end, a connection end, and a bearing mandrel between the head end and the connection end. In some embodiments, the bearing pack may be associated with the bearing mandrel.

In some embodiments, the drill bit may be adapted to be connected directly with the transmission of a drilling apparatus. For example, in some embodiments, the drill bit may be adapted to be connected directly or indirectly with a universal joint, constant velocity assembly or flex shaft of a downhole drilling motor, thereby eliminating the drive shaft which is typically connected between the transmission of a downhole drilling motor and a drill bit.

The bearing pack is comprised of at least one bearing. In some embodiments, the bearing pack may be comprised of one or more thrust bearings and/or one or more radial bearings. In some embodiments, the bearings may be interposed between the drill bit and a housing of the drilling apparatus. In some embodiments, the bearings may also be interposed between inner and outer portions of the drill bit. In some embodiments, the drill bit and a housing of the drilling apparatus may provide one or more complementary bearing surfaces for the bearings.

In some embodiments, a lower end of a housing of the drilling apparatus may be comprised of a housing adapter for adapting the housing for use with the drill bit and the bearing pack of the invention. In some embodiments, the drill-bit and the housing adapter may provide one or more complementary bearing surfaces for the bearings.

In some embodiments, the drilling apparatus may include a bend. In some embodiments, the bend may be provided by the housing. In some embodiments, the bend may be provided by a lower end of the housing. In some embodiments, the bend may be provided by a housing adapter at a lower end of the housing. In some embodiments, the bend may be adjustable either while the drilling apparatus is at the ground surface or while the drilling apparatus is deployed in a borehole.

In an exemplary aspect, the invention is a drilling apparatus comprising:

(a) a housing having a housing lower end;

(b) a drill bit, the drill bit having a head end extending from the housing lower end, a connection end contained within the housing, and a bearing mandrel between the head end and the connection end;

(c) a bearing pack associated with the bearing mandrel and the housing, for transmitting forces between the drill bit and the housing, the bearing pack comprising at least one bearing interposed between the bearing mandrel and the housing; and (d) a drive mechanism connected with the connection end of the drill bit, for driving the drill bit.

The bearing pack may be comprised of any number of bearings. In some embodiments, the bearing pack may be comprised of at least one radial bearing interposed between the bearing mandrel and the housing. In some embodiments, the bearing pack may be comprised of at least one thrust bearing interposed between the bearing mandrel and the housing. In some embodiments, the bearing pack may be comprised of at least one radial bearing interposed between the bearing mandrel and the housing and at least one thrust bearing interposed between the bearing mandrel and the housing.

The drill bit may be configured in any manner to provide the head end, the connection end, and the bearing mandrel.

In some embodiments, the bearing mandrel and the housing may provide bearing surfaces for the bearings of the bearing pack. The bearing surfaces may be provided in any suitable manner. The bearing surfaces may be comprised of radial bearing surfaces for the radial bearings and thrust bearing surfaces for the thrust bearings.

In some embodiments, the drilling apparatus may be further comprised of one or more bearing collars on the bearing mandrel for providing one or more thrust bearing surfaces on the bearing mandrel. The one or more bearing collars may be associated with the bearing mandrel in any suitable manner. In some embodiments, the one or more bearing collars may be threadably connected with the bearing mandrel. In some embodiments, the one or more bearing collars may be connected with the bearing mandrel with one or more set screws.

In some embodiments, the drill bit may be comprised of an outer drill bit portion and an inner drill bit portion. In some embodiments, a bit annular space may be defined between the outer drill bit portion and the inner drill bit portion. In some embodiments, the bit annular space may extend along at least a portion of the bearing mandrel. In some embodiments, the housing lower end may be received within the bit annular space.

In some embodiments in which the drill bit is comprised of an outer drill bit portion and an inner drill bit portion, at least one bearing of the bearing pack may be contained in the bit annular space. In some such embodiments, at least one radial bearing may be contained in the bit annular space.

In some embodiments in which the drill bit is comprised of an outer drill bit portion and an inner drill bit portion and the drilling apparatus is comprised of one or more bearing collars on the bearing mandrel, the one or more bearing collars may be associated with the inner drill bit portion. The one or more bearing collars may be associated with the inner drill bit portion in any suitable manner. In some embodiments, the one or more bearing collars may be threadably connected with the inner drill bit portion. In some embodiments, the one or more bearing collars may be connected with the inner drill bit portion with one or more set screws.

In some embodiments in which the drill bit is comprised of an outer drill bit portion and an inner drill bit portion, the drilling apparatus may be further comprised of a bearing retainer for maintaining the at least one bearing in the bit annular space. In some embodiments, the bearing retainer may be connected with the outer drill bit portion. The bearing retainer may be connected with the outer drill bit portion in any manner. In some embodiments, the bearing retainer may be threadably connected with the outer drill bit portion.

The outer drill bit portion and the inner drill bit portion may be comprised of a single component or may be comprised of separate components. In embodiments in which the outer drill bit portion and the inner drill bit portion are comprised of separate components, the outer drill bit portion and the inner drill bit portion may be configured and connected together in any suitable manner.

In some embodiments in which the outer drill bit portion and the inner drill bit portion are comprised of separate components, the inner drill bit portion may be received within the outer drill bit portion. In such embodiments, the outer drill bit portion may define a socket and the inner drill bit portion may be received within the socket of the outer drill bit portion.

In some embodiments in which the outer drill bit portion and the inner drill bit portion are comprised of separate components, the outer drill bit portion and the inner drill bit portion may be connected together so that relative rotation and/or relative axial movement of the outer drill bit portion and the inner drill bit portion are inhibited or prevented.

In some embodiments in which the outer drill bit portion and the inner drill bit portion are comprised of separate components, the outer drill bit portion and the inner drill bit portion may be comprised of complementary splines for inhibiting or preventing relative rotation of the outer drill bit portion and the inner drill bit portion.

In some embodiments in which the outer drill bit portion and the inner drill bit portion are comprised of separate components, relative axial movement of the outer drill bit portion and the inner drill bit portion may be inhibited or prevented by the at least one bearing contained in the bit annular space and by the bearing retainer.

BRIEF DESCRIPTION OF DRAWINGS

Embodiments of the invention will now be described with reference to the accompanying drawings, in which.

DETAILED DESCRIPTION

Exemplary embodiments of a drilling apparatus according to the invention, including a drill bit and a bearing pack, are described with reference to FIGS. 1-6.

Figure 1:
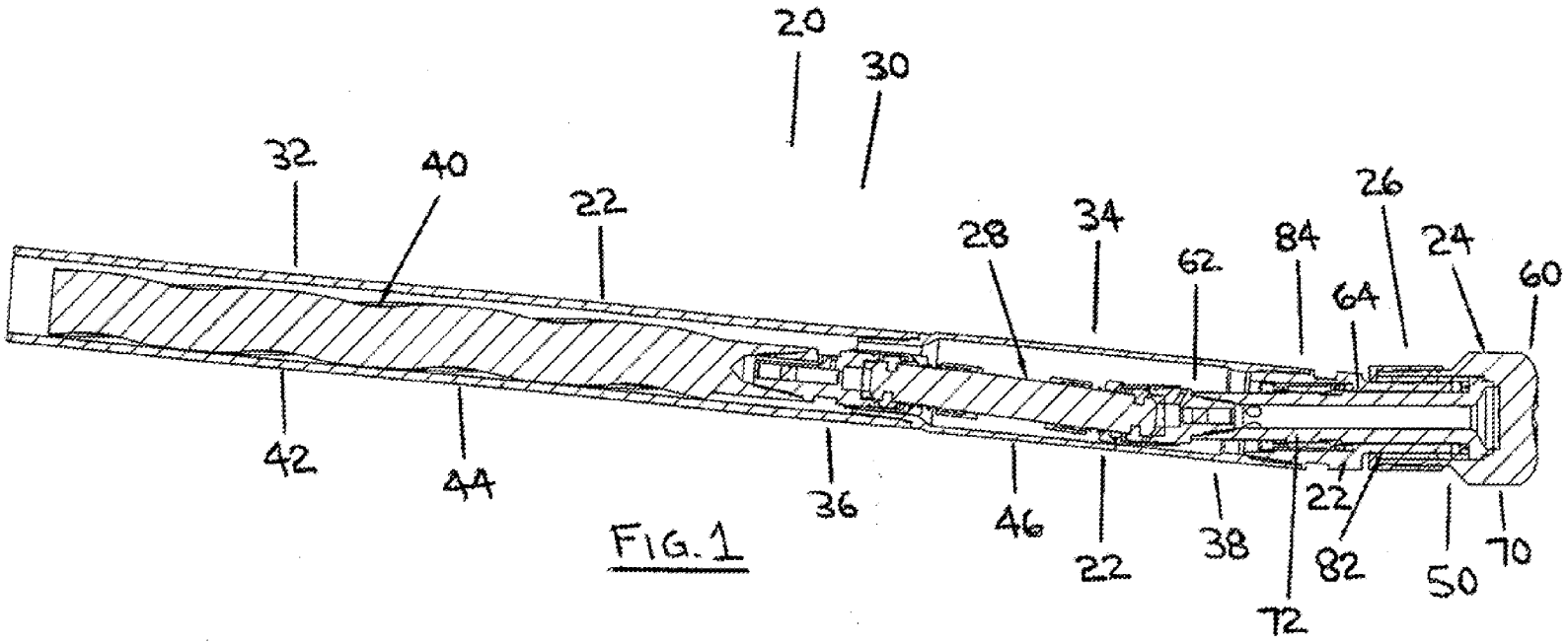
FIG. 1 is a longitudinal section assembly drawing of a first exemplary embodiment of a drilling apparatus according to the invention.
Figure 2:
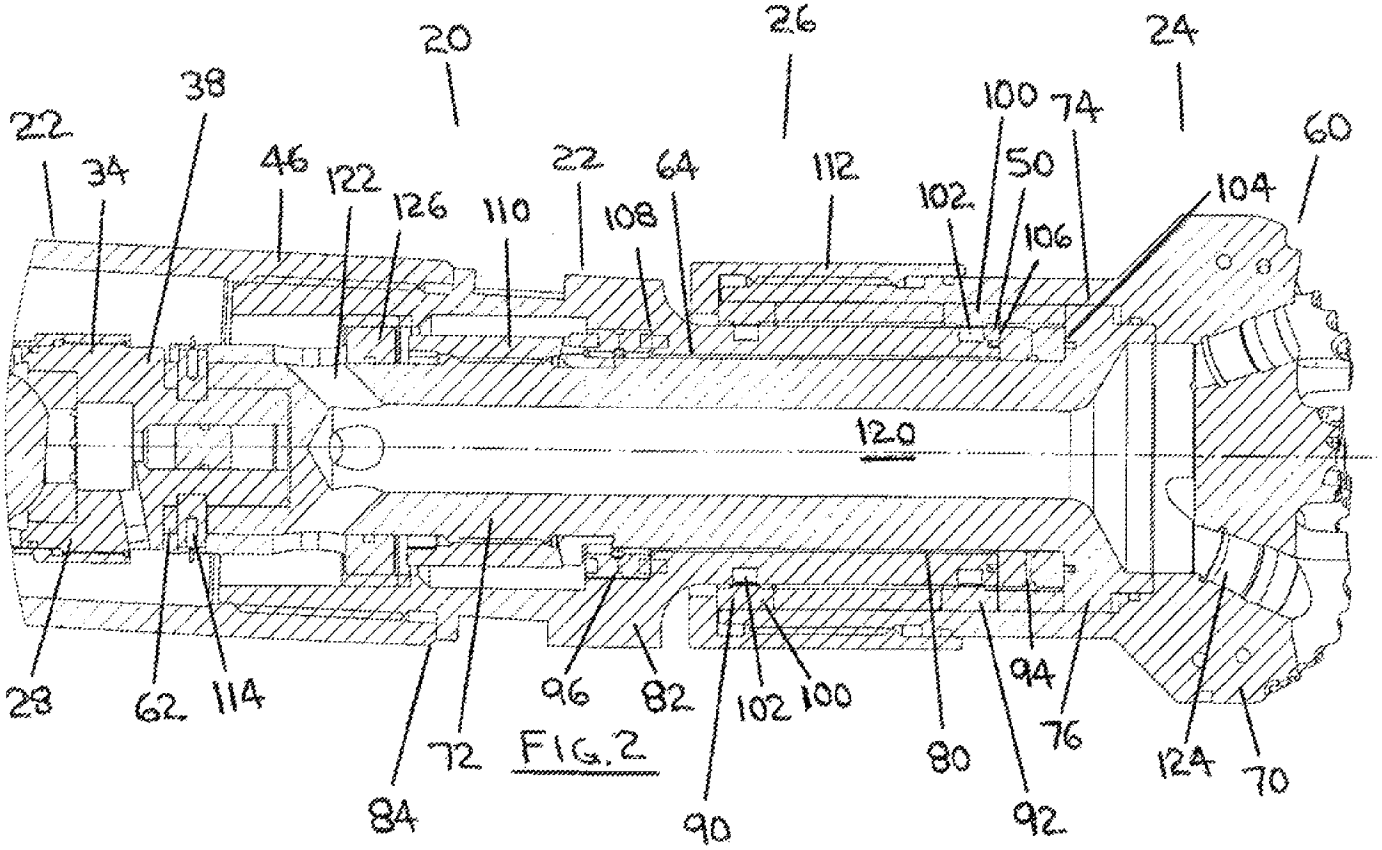
FIG. 2 is a longitudinal section assembly drawing of a lower end of the drilling apparatus of FIG. 1, detailing the drill bit and the bearing pack.

A first exemplary embodiment of a drilling apparatus according to the invention is depicted in FIGS. 1-2. FIG. 1 depicts the drill bit and the bearing pack of the first exemplary embodiment with other exemplary components of a drilling apparatus. FIG. 2 details the drill bit and the bearing pack of the first exemplary embodiment.

Figure 3:
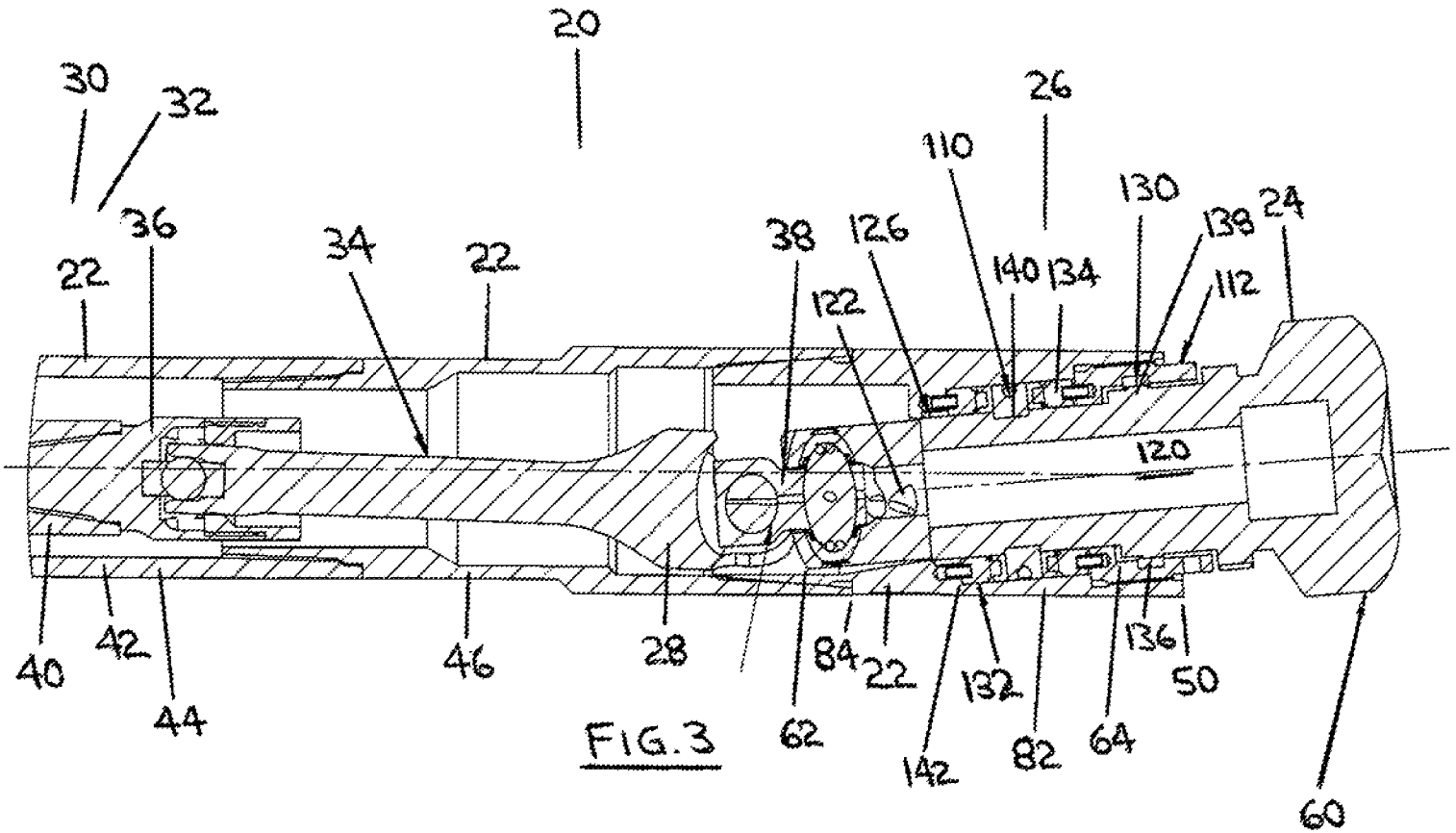
FIG. 3 is a longitudinal section assembly drawing of a second exemplary embodiment of a drilling apparatus according to the invention, detailing the drill bit and the bearing pack.

A second exemplary embodiment of a drilling apparatus according to the invention is depicted in FIG. 3. FIG. 3 details the drill bit and the bearing pack of the second exemplary embodiment.

Figure 4:
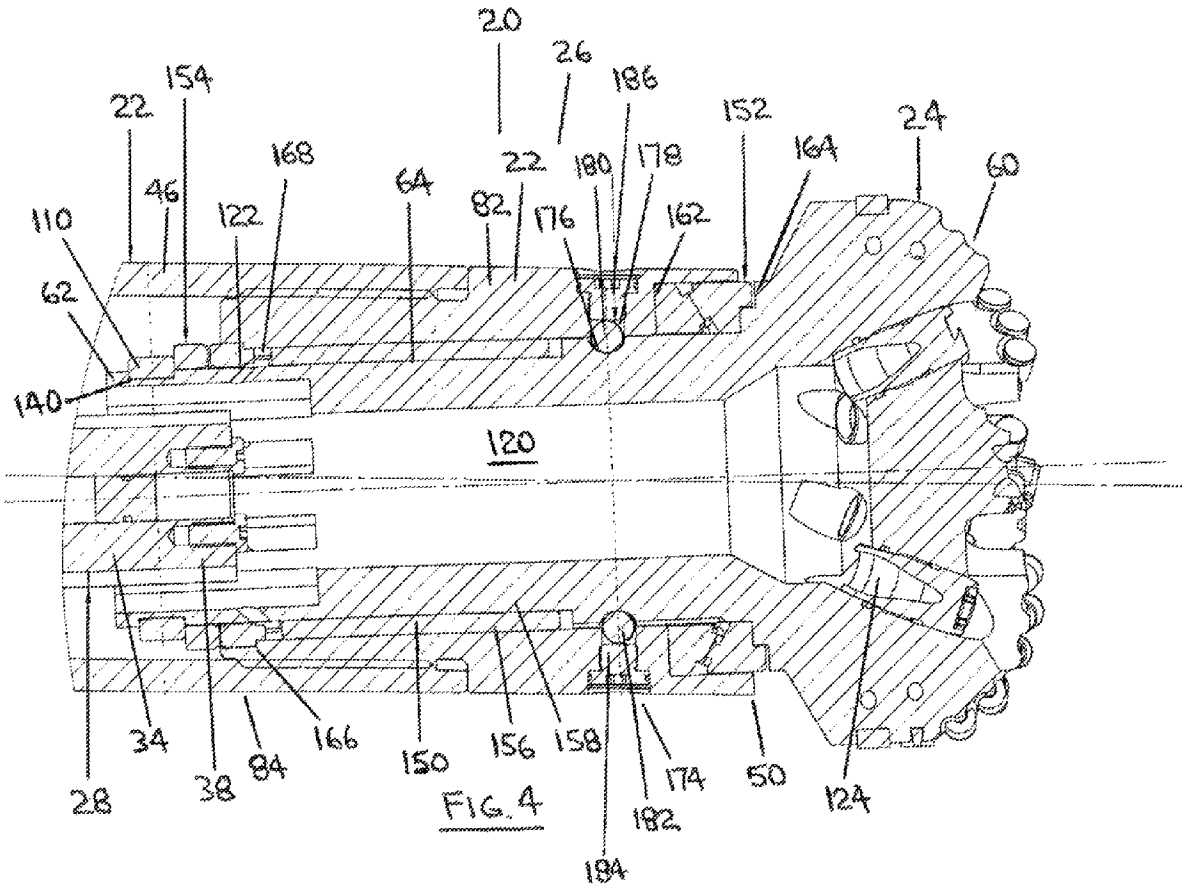
FIG. 4 is a longitudinal section assembly drawing of a third exemplary embodiment of a drilling apparatus according to the invention, detailing the drill bit and the bearing pack.
Figure 5:
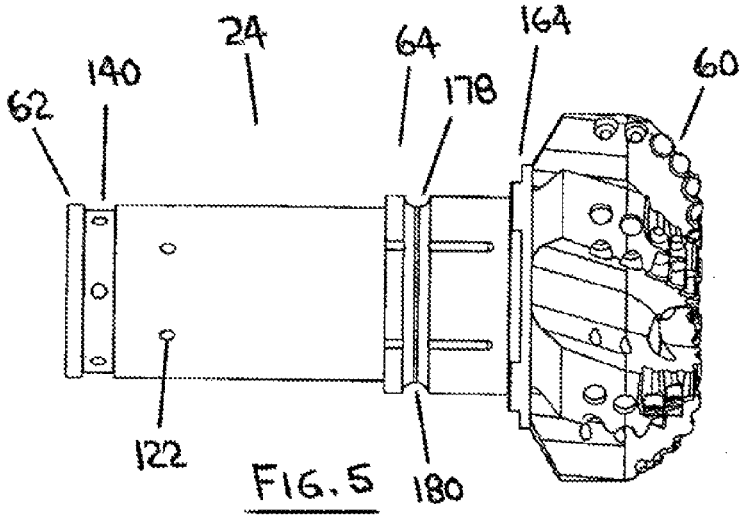
FIG. 5 is a side view of the drill bit from the drilling apparatus of FIG. 4.
Figure 6:
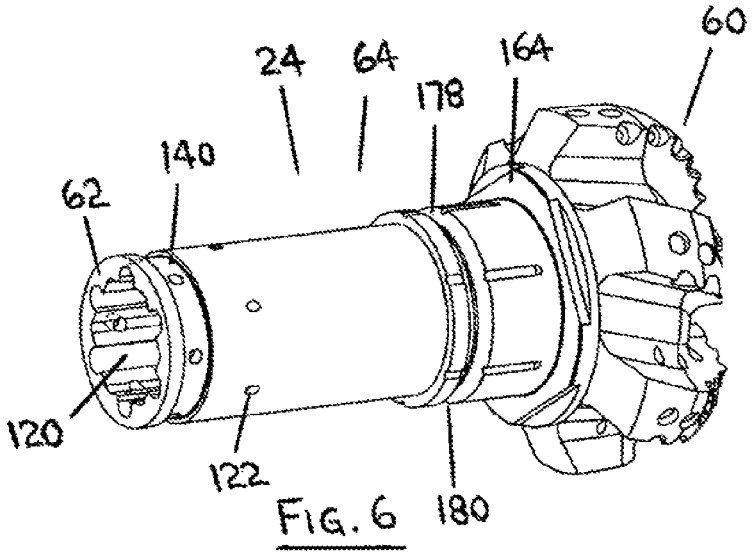
FIG. 6 is a pictorial view of the drill bit from the drilling apparatus of FIG. 4.

A third exemplary embodiment of a drilling apparatus according to the invention is depicted in FIGS. 4-6. FIG. 4 details the drill bit and the bearing pack of the third exemplary embodiment. FIGS. 5-6 depict only the drill bit of the third exemplary embodiment.

Components of the drilling apparatus which are depicted in FIG. 1 with the drill bit and the bearing pack of the first exemplary embodiment may be adapted for use with the second exemplary embodiment and/or the third exemplary embodiment.

In the description of the exemplary embodiments which follows, parts and features of one exemplary embodiment which are identical to or analogous to parts and features in other exemplary embodiments may be indicated with a common reference number.

In all of the exemplary embodiments depicted in FIGS. 1-6, a drilling apparatus (20) comprises a housing (22), a drill bit (24), a bearing pack (26), and a drive mechanism (28) for driving the drill bit.

In the exemplary embodiments depicted in FIGS. 1-6, the drilling apparatus (20) is comprised of components of a downhole drilling motor (30). In other embodiments, the drilling apparatus (20) may be comprised of components of a rotary steerable tool (not shown), a steering tool (not shown), or some other form of drilling apparatus (20).

Referring to FIG. 1, in the exemplary embodiments the drilling apparatus (20) is comprised of a power section (32) and a transmission (34) of a downhole drilling motor (30).

In the exemplary embodiments, the power section (32) is a progressing cavity power section (32) which comprises a rotatable rotor (40) within a stator (42). In the exemplary embodiments, the stator (42) provides a power section housing (44) of the drilling apparatus (20). The rotor (40) is driven by fluid (not shown) which is circulated through the drilling apparatus (20).

The rotor (40) rotates eccentrically within the stator (42). The transmission (34) has a transmission input end (36) and a transmission output end (38). The rotor (40) is connected with the transmission input end (36).

In the exemplary embodiments, the transmission (34) is comprised of a constant velocity assembly. In other embodiments, the transmission (34) may be comprised of a flex shaft or some other suitable structure, device or apparatus.

The transmission (34) converts the eccentric rotation of the rotor (40) at the transmission input end (36) into a non-eccentric rotation at the transmission output end (38). In the exemplary embodiments, the transmission (34) is contained within a transmission section housing (44) of the drilling apparatus (20).

In the exemplary embodiments, the power section housing (44) and the transmission section housing (46) are separate components of the housing (22) which are threadably connected together. In other embodiments, the power section housing (44) and the transmission section housing (46) may be connected together in some other manner or may be constructed as a single component.

In a conventional drilling apparatus, the transmission output end (38) may be connected with one or more lengths of shaft (not shown) which are interposed between the transmission (34) and the drill bit (24) in a conventional drilling apparatus, the one or more lengths of shaft may be supported within a bearing section (not shown) of the drilling apparatus, which transmits axial and radial forces between the one or more lengths of shaft and the housing (22) of the drilling apparatus.

In the exemplary embodiments of the drilling apparatus (20), the transmission output end (38) is connected directly with the drill bit (24), thereby eliminating the one or more lengths of shaft which are interposed between the transmission (34) and the drill bit (24). As a result, in the exemplary embodiments, the bearing section of a conventional drilling apparatus is replaced with the bearing pack (26), which bearing pack (26) is associated with the drill bit (24).

More particularly, in the exemplary embodiments depicted in FIGS. 1-6, the housing (22) of the drilling apparatus (20) has a housing lower end (50). The drill bit (24) has a head end (60) extending from the housing lower end (50), a connection end (62) contained within the housing (22), and a bearing mandrel (64) between the head end (60) and the connection end (62).

In the exemplary embodiments depicted in FIGS. 1-6, the bearing pack (26) is associated with the bearing, mandrel (64) and the housing (22), and transmits forces between the drill bit (24) and the housing (22). The bearing pack (26) comprises at least one bearing.

In the exemplary embodiments, the power section (32) and the transmission (34) are components of a drive mechanism for the drilling apparatus (20). In the exemplary embodiments depicted in FIGS. 1-6, the connection end (62) of the drill bit (24) is connected directly with the transmission (34) of the drilling apparatus (20). As a result, in the exemplary embodiments depicted in FIGS. 1-6, the connection end (62) of the drill bit (24) is connected directly with the drive mechanism so that the drive mechanism can rotate and thus drive the drill bit (24).

The first exemplary embodiment of the drilling apparatus (20) is now described with reference to FIGS. 1-2. FIG. 1 depicts the drill bit (24) and the bearing pack (26) of the first exemplary embodiment with other components of the drilling apparatus (20). FIG. 2 provides a detail view of the drill bit (24) and the bearing pack (26) of the first exemplary embodiment.

Referring to FIG. 2, in the first exemplary embodiment the drill bit (24) is comprised of an outer drill bit portion (70) and an inner drill bit portion (72), which as depicted in FIG. 1-2 may be constructed as separate components. In the first exemplary embodiment as depicted in FIG. 1-2, the inner drill bit portion (72) is received within the outer drill bit portion (70). More particularly, in the first exemplary embodiment as depicted in FIGS. 1-2, the outer drill bit portion (70) defines a socket (74) and the inner drill bit portion (72) is received within the socket (74).

In the first exemplary embodiment as depicted in FIGS. 1-2, the outer drill bit portion (70) and the inner drill bit portion (72) are provided with complementary splines (76) to inhibit or prevent relative rotation of the outer drill bit portion (70) and the inner drill bit portion (72).

Referring to FIG. 2, in the first exemplary embodiment, a bit annular space (80) is defined between the outer drill bit portion (70) and the inner drill bit portion (72) along at least a portion of the bearing mandrel (64).

Referring to FIG. 2, in the first exemplary embodiment, the housing (22) is comprised of a housing adapter (82) which provides the housing lower end (50). In the first exemplary embodiment, the housing adapter (82) is threadably connected with the transmission section housing (46). In other embodiments, the housing adapter (82) may be connected with the transmission section housing (46) in some other manner or the transmission section housing (46) and the housing adapter (82) may be constructed as a single component.

Referring to FIG. 2, in the first exemplary embodiment, the housing adapter (82) is configured to connect with the transmission section housing (46) to provide a bend (84) in the housing (22) adjacent to the transmission output end (38). In some embodiments, the bend (84) may be adjustable either while the drilling apparatus (20) is at the ground surface (not shown) or while the drilling apparatus (20) is deployed in a borehole (not shown). In other embodiments, no bend (84) may be provided.

Referring again to FIG. 2, in the first exemplary embodiment, the housing lower end (50), which is provided by the housing adapter (82), is received within the bit annular space (80).

In the first exemplary embodiment, the bearing pack (26) is comprised of an upper radial bearing (90), a lower radial bearing (92), an on-bottom thrust bearing (94), and an off-bottom thrust bearing (96). The upper radial bearing (90), the lower radial bearing (92) and the on-bottom thrust bearing (94) are contained within the bit annular space (80), and are interposed between the bearing mandrel (64) and the housing adapter (82). The off-bottom thrust bearing (96) is not contained within the bit annular space (80), but is interposed between the bearing mandrel (64) and the housing adapter (82).

Referring to FIG. 2, in the first exemplary embodiment, the radial bearings (90, 92) are comprised of outer radial bearings (100) connected with the outer drill head portion (70) along the bearing mandrel (64) and inner radial bearings (102) mounted on the housing adapter (82). The outer radial bearings (100) and the inner radial bearings (102) provide complementary radial bearing surfaces for the radial bearings (90, 92). In the first exemplary embodiment, the radial bearings (90, 92) may be comprised of diamond bearings.

In the first exemplary embodiment, the on-bottom thrust bearing (94) is interposed between complementary thrust bearing surfaces comprising a bearing shoulder (104) on the inner drill bit portion (72) and a tip (106) of the housing lower end (50). When a compression load is applied to the head end (60) of the drill bit (24) when the drill bit (24) is "on-bottom", the load is transmitted from the bearing shoulder (104), through the on-bottom thrust bearing (94), and into the housing adapter (82).

In the first exemplary embodiment, the off-bottom thrust bearing (96) is interposed between complementary thrust bearing surfaces comprising a bearing shoulder (108) on the housing adapter (82) and a bearing collar (110) which is threadably connected with the inner drill bit portion (72) on the bearing mandrel (64). When the drill bit (24) is "off-bottom", the weight of the rotor (40), the transmission (34) and the drill bit (24) is transmitted from the bearing collar (110), through the off-bottom thrust bearing (96), and into the housing adapter (82).

In the first exemplary embodiment, the drilling apparatus (20) may be provided with an amount of "bearing play" to enable the drill bit (24) to move axially a slight amount relative to the housing adapter (82) in order to exert loads on the on-bottom thrust bearing (94) and the off-bottom thrust bearing (96), as required. The bearing play may be provided as a gap, or spring elements (not shown) may be included in the drilling apparatus (20) to cushion and/or absorb the bearing play.

Referring to FIG. 2, in the first exemplary embodiment, a bearing retainer (112) is threadably connected with the outer drill bit portion (70). The bearing retainer (112) assists in retaining components of the bearings (90, 92, 94) in the bit annular space (80) and assists in inhibiting or preventing relative axial movement of the outer drill bit portion (70) and the inner drill bit portion (72).

Referring to FIGS. 1-2, in the first exemplary embodiment, the connection end (62) of the drill bit (24) is provided by the inner drill bit portion (72). The connection end (62) of the drill bit (24) is connected to the transmission output end (38) with pins (120).

Referring to FIGS. 1-2, in the first exemplary embodiment, the power section (32) of the drilling apparatus (20) is powered by the circulation of fluid (not shown) through the drilling apparatus (20). In the first exemplary embodiment, the inner drill bit portion (72) and the outer drill bit portion (70) define a drill bit bore (120).

Referring to FIG. 2, the inner drill bit portion (72) is provided with flow ports (122) for allowing a portion of the fluid circulating through the drilling apparatus (20) to enter the drill bit bore (120). The portion of the fluid which does not enter the drill bit bore (120) circulates along the exterior of the inner drill bit portion (72) and through the bit annular space (80) in order to lubricate and cool the bearings (90, 92, 94, 96).

Referring to FIG. 2, the outer drill bit portion (70) is provided with flow nozzles (124) for allowing the fluid circulating through the drilling apparatus (20) to exit the drilling apparatus (20) in order to cool the head end (60) of the drill bit (24), assist in removing cuttings from the end (not shown) of the borehole (not shown), and circulate through the borehole back to the ground surface (not shown).

Referring to FIG. 2, in the first exemplary embodiment, the bearing pack (26) is further comprised of a radial bearing flow restrictor (126) which is interposed between the bearing mandrel (64) and the housing adapter (82) adjacent to the flow ports (122). The radial bearing flow restrictor (126) radially supports the upper end of the inner drill head portion (72) and controls or meters the portion of fluid which circulates along the exterior of the inner drill bit portion (72). In the first exemplary embodiment, the flow ports (122) and the radial bearing flow restrictor (126) may be configured to allow about five percent of the fluid circulating through the apparatus (20) to circulate along the exterior of the inner drill bit portion (72). In the first exemplary embodiment, the radial bearing flow restrictor (126) may be comprised of a carbide bearing.

The second exemplary embodiment of the drilling apparatus (20) is now described with reference to FIG. 3. FIG. 3 provides a detail view of the drill bit (24) and the bearing pack (26) of the second exemplary embodiment. The drill bit (24) and the bearing pack (26) of the second exemplary embodiment are incorporated into a drilling apparatus (20) comprising a power section (32) and a transmission (34) similar to the drilling apparatus depicted in FIG. 1.

Referring to FIG. 3, in the second exemplary embodiment the drill bit (24) is constructed as a single piece or component. As a result, in the second exemplary embodiment, the drill bit (24) is not comprised of an outer drill bit portion and an inner drill bit portion.

Referring to FIG. 3, in the second exemplary embodiment, the housing (22) is comprised of a housing adapter (82) which provides the housing lower end (50). In the second exemplary embodiment, the housing adapter (82) is threadably connected with the transmission section housing (46). In other embodiments, the housing adapter (82) may be connected with the transmission section housing (46) in some other manner or the transmission section housing (46) and the housing adapter (82) may be constructed as a single component.

Referring to FIG. 3, in the second exemplary embodiment, the housing adapter (82) is configured to connect with the transmission section housing (46) to provide a bend (84) in the housing (22) adjacent to the transmission output end (38). In some embodiments, the bend (84) may be adjustable either while the drilling apparatus (20) is at the ground surface (not shown) or while the drilling apparatus (20) is deployed in a borehole (not shown). In other embodiments, no bend (84) may be provided.

In the second exemplary embodiment, the bearing pack (26) is comprised of a lower radial bearing (130), an on-bottom thrust bearing (132), and an off-bottom thrust bearing (134). The bearings (130, 132, 134) are interposed between the bearing mandrel (64) and the housing adapter (82).

Referring to FIG. 3, in the second exemplary embodiment, a bearing retainer (112) is threadably connected with a tip (106) of the housing adapter (82). The bearing retainer (112) assists in retaining components of the bearings (130, 132, 134) in position between the bearing mandrel (64) and the housing adapter (82).

Referring to FIG. 3, in the second exemplary embodiment, the lower radial bearing (130) is comprised of an outer radial bearing (136) and an inner radial bearing (138). The outer radial bearing (136) is mounted on the bearing retainer (112) and the inner radial bearing (138) is mounted on the bearing mandrel (64). The outer radial bearing (136) and the inner radial bearing (138) provide complementary radial bearing surfaces for the lower radial bearing (130). In the second exemplary embodiment, the lower radial bearing (130) may be comprised of a diamond bearing.

Referring to FIG. 3, in the second exemplary embodiment, a bearing collar (110) is mounted with set screws in a recess (140) on the bearing mandrel (64).

In the second exemplary embodiment, the on-bottom thrust bearing (132) is interposed between complementary thrust bearing surfaces comprising a bearing shoulder (142) on the housing adapter (82) and the bearing collar (110). When a compression load is applied to the head end (60) of the drill bit (24) when the drill bit (24) is "on-bottom", the load is transmitted from the bearing collar (110), through the on-bottom thrust bearing (132), and into the housing adapter (82).

In the second exemplary embodiment, the off-bottom thrust bearing (134) is interposed between complementary thrust bearing surfaces comprising the end of the bearing retainer (112) and the bearing collar (110). When the drill bit (24) is "off-bottom", the weight of the rotor (40), the transmission (34) and the drill bit (24) is transmitted from the bearing collar (110), through the off-bottom thrust bearing (134), into the bearing retainer (112), and into the housing adapter (82).

In the second exemplary embodiment, the drilling apparatus (20) may be provided with an amount of "bearing play" to enable the drill bit (24) to move axially a slight amount relative to the housing adapter (82) in order to exert loads on the on-bottom thrust bearing (132) and the off-bottom thrust bearing (134), as required. The bearing play may be provided as a gap, or spring elements (not shown) may be included in the drilling apparatus (20) to cushion and/or absorb the bearing play.

Referring to FIG. 3, in the second exemplary embodiment, the connection end (62) of the drill bit (24) is connected to the transmission output end (38).

Referring to FIG. 1 and FIG. 3, in the second exemplary embodiment, the power section (32) of the drilling apparatus (20) is powered by the circulation of fluid (not shown) through the drilling apparatus (20). In the second exemplary embodiment, the drill bit (24) defines a drill bit bore (120).

Referring to FIG. 3, the drill bit (24) is provided with flow ports (122) for allowing a portion of the fluid circulating through the drilling apparatus (20) to enter the drill bit bore (120). The portion of the fluid which does not enter the drill bit bore (120) circulates along the exterior of the drill bit (24) in order to lubricate and cool the bearings (130, 132, 134).

Referring to FIG. 3, the drill bit (24) is provided with flow nozzles (not shown in FIG. 3) for allowing the fluid circulating through the drilling apparatus (20) to exit the drilling apparatus (20) in order to cool the head end (60) of the drill bit (24), assist in removing cuttings from the end (not shown) of the borehole (not shown), and circulate through the borehole back to the ground surface (not shown).

Referring to FIG. 3, in the second exemplary embodiment, the bearing pack (26) is further comprised of a radial bearing flow restrictor (126) which is interposed between the bearing mandrel (64) and the housing adapter (82) adjacent to the flow ports (122). The radial bearing flow restrictor (126) radially supports the upper end of the drill bit (24) and controls or meters the portion of fluid which circulates along the exterior of the drill bit (24). In the second exemplary embodiment, the flow ports (122) and the radial bearing flow restrictor (126) may be configured to allow about five percent of the fluid circulating through the apparatus (20) to circulate along the exterior of the drill bit (24). In the second exemplary embodiment, the radial bearing flow restrictor (126) may be comprised of a carbide bearing.

The third exemplary embodiment of the drilling apparatus (20) is now described with reference to FIGS. 4-6. FIG. 4 provides a detail view of the drill bit (24) and the bearing pack (26) of the third exemplary embodiment. FIG. 5 provides a side view of the drill bit (24) of the third exemplary embodiment. FIG. 6 provides a pictorial view of the drill bit (24) of the third exemplary embodiment. The drill bit (24) and the bearing pack (26) of the third exemplary embodiment are incorporated into a drilling apparatus (20) comprising a power section (32) and a transmission (34) similar to the drilling apparatus depicted in FIG. 1.

Referring to FIGS. 4-6, in the third exemplary embodiment the drill bit (24) is constructed as a single piece or component. As a result, in the third exemplary embodiment, the drill bit (24) is not comprised of an outer drill bit portion and an inner drill bit portion.

Referring to FIG. 4, in the third exemplary embodiment, the housing (22) is comprised of a housing adapter (82) which provides the housing lower end (50). In the third exemplary embodiment, the housing adapter (82) is threadably connected with the transmission section housing (46). In other embodiments, the housing adapter (82) may be connected with the transmission section housing (46) in some other manner or the transmission section housing (46) and the housing adapter (82) may be constructed as a single component.

Referring to FIG. 4, in the third exemplary embodiment, the housing adapter (82) is configured to connect with the transmission section housing (46) to provide a bend (84) in the housing (22) adjacent to the transmission output end (38). In some embodiments, the bend (84) may be adjustable either while the drilling apparatus (20) is at the ground surface (not shown) or while the drilling apparatus (20) is deployed in a borehole (not shown). In other embodiments, no bend (84) may be provided.

Referring to FIG. 4, in the third exemplary embodiment, the bearing pack (26) is comprised of a radial bearing (150), an on-bottom thrust bearing (152), and an off-bottom thrust bearing (154). The bearings (150, 152, 154) are interposed between the bearing mandrel (64) and the housing adapter (82).

Referring to FIG. 4, in the third exemplary embodiment, the radial bearing (150) is comprised of an outer radial bearing (156) and an inner radial bearing (158). The outer radial bearing (156) is mounted on the housing adapter (82) and the inner radial bearing (158) is mounted on the bearing mandrel (64). The outer radial bearing (156) and the inner radial bearing (158) provide complementary radial bearing surfaces for the radial bearing (150). In the third exemplary embodiment, the radial bearing (150) may be comprised of a diamond bearing.

Referring to FIGS. 4-6, in the third exemplary embodiment, a bearing collar (110) is mounted with set screws in a recess (140) on the bearing mandrel (64).

In the third exemplary embodiment, the on-bottom thrust bearing (152) is interposed between complementary thrust bearing surfaces comprising a bearing shoulder (162) on the housing adapter (82) and a bearing shoulder (164) on the drill bit (24). When a compression load is applied to the head end (60) of the drill bit (24) when the drill bit (24) is "on-bottom"; the load is transmitted from the drill bit (24), through the on-bottom thrust bearing (152), and into the housing adapter (82).

In the third exemplary embodiment, the off-bottom thrust bearing (154) is interposed between complementary thrust bearing surfaces comprising a bearing shoulder (166) on the housing adapter (82) and the bearing collar (110). When the drill bit (24) is "off-bottom", the weight of the rotor (40), the transmission (34) and the drill bit (24) is transmitted from the bearing collar (110), through the off-bottom thrust bearing (154), and into the housing adapter (82).

In the third exemplary embodiment, the drilling apparatus (20) may be provided with an amount of "bearing play" to enable the drill bit (24) to move axially a slight amount relative to the housing adapter (82) in order to exert loads on the on-bottom thrust bearing (152) and the off-bottom thrust bearing (154), as required. The bearing play may be provided as a gap, or spring elements (not shown) may be included in the drilling apparatus (20) to cushion and/or absorb the bearing play.

Referring to FIG. 4, in the third exemplary embodiment, the connection end (62) of the drill bit (24) is connected to the transmission output end (38).

Referring to FIG. 1 and FIG. 4, in the third exemplary embodiment, the power section (32) of the drilling apparatus (20) is powered by the circulation of fluid (not shown) through the drilling apparatus (20). In the third exemplary embodiment, the drill bit (24) defines a drill bit bore (120).

Referring to FIGS. 4-6, the drill bit (24) is provided with flow ports (122) for allowing a portion of the fluid circulating through the drilling apparatus (20) to enter the drill bit bore (120). The portion of the fluid which does not enter the drill bit bore (120) circulates along the exterior of the drill bit (24) in order to lubricate and cool the bearings (150, 152).

Referring to FIG. 4, the drill bit (24) is provided with flow nozzles (124) for allowing the fluid circulating through the drilling apparatus (20) to exit the drilling apparatus (20) in order to cool the head end (60) of the drill bit (24), assist in removing cuttings from the end (not shown) of the borehole (not shown), and circulate through the borehole back to the ground surface (not shown).

Referring to FIG. 4, in the third exemplary embodiment, the bearing pack (26) is further comprised of a flow restrictor (168) which is interposed between the bearing mandrel (64) and the housing adapter (82) adjacent to the flow ports (122). The flow restrictor (168) controls or meters the portion of fluid which circulates along the exterior of the drill bit (24). In the third exemplary embodiment, the flow ports (122) and the flow restrictor (168) may be configured to allow about five percent of the fluid circulating through the apparatus (20) to circulate along the exterior of the drill bit (24).

Referring to FIGS. 4-6, in the third exemplary embodiment, the drilling apparatus (20) is comprised of a safety retention mechanism (174) for reducing the likelihood of the drill bit (24) becoming separated from the drilling apparatus (20).

Referring to FIG. 4, the safety retention mechanism (174) is comprised of a circumferential housing recess (176) in the housing adapter (82) and a complementary circumferential drill bit recess (178) in the bearing mandrel (64) which together define an annular track (180) between the housing adapter (82) and the drill bit (24). During assembly of the drilling apparatus (20), the annular track (180) may be filled with ball bearings (182) and grease (not shown) via ports (184) in the housing adapter (82). Once the annular track (180) is filled with the ball bearings (182) and the grease, the ports (184) may be sealed with plugs (186). The safety retention mechanism (174) allows the drill bit (24) to rotate freely relative to the housing adapter (82) while preventing the drill bit (24) from falling through the housing adapter (82).

Drill bits (24), bearing packs (26) and drilling apparatus (20) may be configured differently from the exemplary embodiments within the scope of the invention by combining, adapting, modifying, changing or otherwise varying features of the exemplary embodiments. Such variations may include, but are not limited to, the following:

(a) the drive mechanism (28) driving the drill bit (24) may be comprised of any suitable type of drive system, including but not limited to components of a positive displacement (i.e., Moineau type) motor, a fluid driven turbine, or an electrical motor;

(b) the drill bit (24) may be comprised of any suitable type of drill bit, including but not limited to a drag type bit, a rolling type bit, a fixed cutter bit, a rollercone bit etc.

(c) the bearing pack (26) may be lubricated and cooled by fluid circulating through the drilling apparatus (20), or all or portions of the bearing pack (26) may be lubricated and cooled by a lubricating fluid contained within a sealed portion of the drilling apparatus (20) containing all or portions of the bearing pack (26);

(d) the bearing pack (26) may be configured and arranged as in the exemplary embodiments or in some other manner. As non-limiting examples, radial bearings and thrust bearings may be combined in a tapered bearing which is capable of accommodating both radial and thrust loads, a plurality of radial bearings may be omitted or combined into a single radial bearing, and a single radial bearing may be substituted with a plurality of radial bearings;

(e) the drilling apparatus (20) may be comprised of bearings in addition to the bearings which are included in the bearing pack (26). For example, an on-bottom thrust bearing, an off-bottom thrust bearing, and/or a radial bearing may be included in the bearing pack (26) or may be located elsewhere on the drilling apparatus (20); and (f) the drilling apparatus (20) does not need to be provided with a bend (84) in order for advantages of the invention to be achieved. The drilling apparatus (20) may be configured so that the drill bit (24) and the drilling apparatus (20) lie in the same axis.

In use, the drilling apparatus (20) of the invention may be incorporated into a downhole drilling assembly (not shown) and connected with a drill string (not shown) in order to perform drilling in a borehole (not shown). The downhole drilling assembly may be configured for rotary drilling (in which the drill string is rotated from the ground surface) and/or sliding drilling (in which the drill string is not rotated from the ground surface). In circumstances in which the drilling apparatus (20) includes a bend (84), a nutating or wobbling motion of the drill bit (24) can be achieved during rotary drilling.

The drill bit (24) and bearing pack (26) of the invention potentially enable the drilling apparatus (20) to have a shorter length in comparison with conventional drilling apparatus in which a separate bearing section is provided between the transmission (34) and the drill bit (24). This shorter length potentially facilitates a larger bend angle in the drilling apparatus (20), potentially higher build angles, and a reduction in bending moments which are exerted on the drilling apparatus (20) during drilling.

In addition, a potentially shorter distance between the head end (60) of the drill bit (24) and the bearing pack (26) in comparison with conventional drilling apparatus potentially reduces the bending stresses which are exerted on the bearings during drilling.

These shorter distances potentially result in a more compact drilling apparatus (20) in comparison with conventional drilling apparatus, and in increased durability of the drilling apparatus (20) in comparison with conventional drilling apparatus.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A drilling apparatus comprising:

(a) a housing having a housing lower end;

(b) a drill bit, the drill bit having a head end extending from the housing lower end, a connection end contained within the housing, and a bearing mandrel between the head end and the connection end, wherein the drill bit is comprised of an outer drill bit portion and an inner drill hit portion, wherein a bit annular space is defined between the outer drill bit portion and the inner drill bit portion along at least a portion of the bearing mandrel, and wherein the housing lower end is received within the bit annular space;

(c) a bearing pack associated with the bearing mandrel and the housing, for transmitting forces between the drill bit and the housing, the bearing pack comprising at least one bearing interposed between the bearing mandrel and the housing; and (d) a drive mechanism connected with the connection end of the drill bit, for driving the drill bit.

2. The drilling apparatus as claimed in claim 1 wherein at least one bearing of the bearing pack is contained within the hit annular space.

3. The drilling apparatus as claimed in claim 2, further comprising a bearing retainer connected with the outer drill bit portion, for maintaining the at least one bearing in the bit annular space.

4. The drilling apparatus as claimed in claim 3 wherein the bearing pack is comprised of at least one radial bearing interposed between the bearing mandrel and the housing and at least one thrust bearing interposed between the bearing mandrel and the housing, and wherein at least one radial bearing is contained within the bit annular space.

5. The drilling apparatus as claimed in claim 4, further comprising a bearing collar on the bearing mandrel, for providing a thrust bearing surface on the bearing mandrel.

6. The drilling apparatus as claimed in claim 5 wherein the bearing collar is connected with the inner drill bit portion.

7. The drilling apparatus as claimed in claim 3 wherein the outer drill bit portion and the inner drill hit portion are comprised, of separate components and wherein the inner drill bit portion is received within the outer drill bit portion.

8. The drilling apparatus as claimed in claim 7 wherein the outer drill hit portion and the inner drill bit portion are comprised of complementary splines for preventing relative rotation of the outer drill bit portion and the inner drill bit portion.

9. The drilling apparatus as claimed in claim 7 wherein the at least one bearing contained in the bit annular space and the bearing retainer prevent relative axial movement of the outer drill bit portion and the inner drill bit portion.

10. The drilling apparatus as claimed in claim 1 wherein the bearing pack is comprised of at least one radial bearing interposed between the bearing mandrel and the housing and at least one thrust bearing interposed between the bearing, mandrel and the housing.

11. The drilling apparatus as claimed in claim 10, further comprising a bearing collar on the bearing mandrel, for providing a thrust bearing surface on the bearing mandrel.

12. The drilling apparatus as claimed in claim 1 wherein the drilling apparatus is comprised of a downhole motor and wherein the drive mechanism is comprised of one or more components of the downhole motor.

13. The drilling apparatus as claimed in claim 12 wherein the downhole motor is comprised of a transmission and wherein the connection end of the drill bit is connected directly with the transmission.

14. The drilling apparatus as claimed in claim 13 wherein the transmission is comprised of a constant velocity assembly and wherein the connection end of the drill bit is connected with the constant velocity assembly.

15. The drilling apparatus as claimed in claim 1 wherein a bend is provided in the housing adjacent to the housing lower end.

16. The drilling apparatus as claimed in claim 15 wherein the housing is comprised of a housing adapter, wherein the housing, adapter provides the housing lower end, and wherein the housing adapter provides the bend in the housing.

17. The drilling apparatus as claimed in claim 1 wherein the drive mechanism is comprised of a power section and a transmission, wherein the power section comprises a rotor, wherein the transmission has a transmission input end and a transmission output end, wherein the rotor is connected with the transmission input end, and wherein the transmission output end is connected directly with the connection end of the drill bit.

18. The drilling apparatus as claimed in claim 17 wherein the transmission is comprised of a constant velocity assembly.

* * * * *